United States Patent [19]

Graf

[11] Patent Number: 4,744,546

[45] Date of Patent: May 17, 1988

[54] FLUSHING ARRANGEMENT FOR A METALLURGICAL VESSEL

[75] Inventor: Konrad Graf, Asten, Austria

[73] Assignee: Voest-Alpine Aktiengesellschaft, Linz, Austria

[21] Appl. No.: 1,385

[22] Filed: Jan. 8, 1987

[30] Foreign Application Priority Data

Feb. 3, 1986 [AT] Austria ..... 245/86

[51] Int. Cl.[4] ..... C21C 5/48

[52] U.S. Cl. ..... 266/266; 266/218

[58] Field of Search ..... 266/217, 218, 265, 266, 266/270

[56] References Cited

U.S. PATENT DOCUMENTS 4,413,815 11/1983 Duhomez et al. ..... 266/265

FOREIGN PATENT DOCUMENTS 265341 10/1968 Austria .
21861 1/1981 European Pat. Off. .
32350 7/1981 European Pat. Off. .
43338 1/1982 European Pat. Off. .
43787 1/1982 European Pat. Off. .
53554 6/1982 European Pat. Off. .
64449 11/1982 European Pat. Off. .
155255 9/1985 European Pat. Off. .

OTHER PUBLICATIONS

Radex-Rundschau, No. 3, 1981, pp. 499-517.

*Primary Examiner*—L. Dewayne Rutledge
*Assistant Examiner*—Robert L. McDowell
*Attorney, Agent, or Firm*—Collard, Roe & Galgano

[57] ABSTRACT

A flushing arrangement for a metallurgical vessel having a metal outer shell, a bottom lined with a permanent lining, on which adjacently arranged refractory bricks are applied as working lining, and pipes inserted in recesses of the bricks at predetermined sites and having flat cross sections, through which flush gas flows. In order to provide a flushing means that is simple to produce and install and offers a great safety with regard to a melt breakthrough, a rigid supply pipe for flush gas is led through the metal outer shell, reaching into the permanent lining. To its end lying in the permanent lining, at least two, yet at most four, distributing pipes are welded. They diverge from the end of the supply pipe and pass over into straight pipe sections arranged in recesses of the bricks of the working lining. The distributing pipes that are connected to one supply pipe each enclose one brick. The distance of the straight pipe sections from each other corresponds approximately to the width or length of a lining brick. Only the straight pipe sections have flat cross sections.

4 Claims, 3 Drawing Sheets

FLUSHING ARRANGEMENT FOR A METALLURGICAL VESSEL

Figure 3:
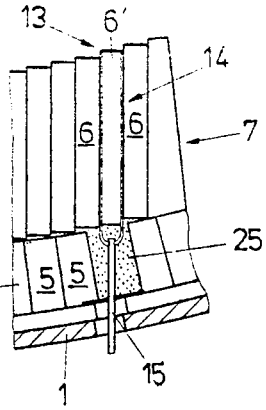

The invention relates to a flushing arrangement for a metallurgical vessel comprising a metal outer shell, a bottom lined with a permanent lining, on which adjacently arranged refractory bricks are applied as working lining, and pipes inserted in recesses of the bricks at predetermined sites and having flat cross sections, through which flush gas flows.

By blowing flush gas into a metal melt, for instance through the bottom of a metallurgical vessel, a stirring effect may be obtained in the metal melt, thus balancing out disequilibriums of composition and temperature, causing the separation of non-metallic inclusions and promoting a certain degassing of the metal melt.

A variety of means are known for the injection of flush gas. Thus, Radex-Rundschau, No. 3, 1981, pp. 499 to 517; EP-A -No. 0 053 554 and EP-A -No. 0 032 350, for instance, show gas-permeable refractory converter flushing bricks as known, wherein such a gas flushing brick is inserted instead of a brick of the refractory lining of the converter. The flushing brick, which has a sheet case including a porous refractory mass to prevent lateral gas exit, which porous mass may be provided with a directed porosity, thus, replaces a conventional brick of the working lining of the converter. The sheet case is open towards the converter interior, on the opposite end of the flushing brick, on which the sheet case is closed, a feed line is connected to the sheet case in a gas-tight manner. Flushing bricks of this type have the disadvantage that they are complex to produce and install and that between the sheet case and the porous refractory mass contained therein an uncontrolled gas penetration may occur in case the refractory mass does not completely contact the sheet case. Furthermore, such a flushing brick is more rapidly worn than the working lining of the converter so that material and time consuming repair measures are required between two relinings of the working lining.

Furthermore, it is known (AT-A -No. 265 341) to embed a tuyere pipe in a refractory flushing brick, which, however, has the disadvantage that the flushing brick—which also has been inserted instead of a conventional brick of the refractory lining of the converter—always must be provided with a certain minimum amount of flush gas as long as the flushing brick is covered by melt in order to prevent the tuyere pipe from getting obstructed by intruding melt.

It is, furthermore, known (EP-A -No. 0 043 338, EP-A -No. 0 021 861 and EP-A -No. 0 043 787) to form a flushing brick of several refractory piece parts with a low porosity or none at all, wherein the piece parts are held together by the sheet case so as to form what is called a sandwich plug, which likewisely is incorporated in the refractory lining of the converter instead of a conventional brick. In the abutting surfaces of the refractory piece parts, longitudinal grooves or grooved metal inserts forming flush-gas conducting cavities are provided. Apart from the fact that such a sandwich plug also is very complex and cumbersome to produce, it has the disadvantage that the gas permeability may change during the service life if a piece part severs from the neighboring piece part or from the sheet case. Moreover, premature wear may not be excluded, because the refractory piece parts are of another composition as the refractory bricks of the working lining.

In order to avoid these disadvantages, it is known (EP-A -No. 0 155 255) to install a metallic flush plate on predetermined sites of the bottom between neighboring refractory bricks, extending between the flushing bricks from one transverse joint to the other. This may lead to a relatively high wear of the bricks at the joints comprising the flush plate. Due to the expansion of the bricks during heating up of the metallurgical vessel, squeezing and, thus, a reduction of the flush-gas amount may occur.

From EP-B -No. 0 064 449, a flushing means of the initially defined kind is known, in which several flattened pipes departing from a distributor located outside of the vessel are led through the converter shell and the permanent lining and are inserted in recesses cut into neighboring bricks of the working lining. In doing so, the danger of squeezing due to brick expansion and an early wear of the joints are prevented, yet there is the danger of leakages forming because of the distributor being located outside of the converter shell.

The installation of the above means into the metallurgical vessel is rather complex, too, because the pipes have to be led through the permanent lining individually and fixed in the region of the permanent lining by ramming mass. Damage to the pipes and bending of the same cannot be excluded, whereby the pipes no longer come to lie on the predetermined sites on which the corresponding pipe-receiving recesses of the bricks of the working lining are arranged. For this reason, it is necessary to carry out corrections of the pipe distances during the entire installation procedure. Moreover, the bricks of the working lining into which the pipes are inserted cannot be pre-fabricated, since the final position of the pipes is fixed only after having been rammed into the permanent lining. It is also necessary to provide a relatively large area with ramming mass, which means a reduced safety with regard to a melt breakthrough.

The invention aims at avoiding these disadvantages and difficulties and has as its object to provide a flushing means of the initially defined kind, which is simple to produce and install, which offers a great safety with regard to a melt breakthrough and which allows for the pre-fabrication of the bricks of the working lining that receive the flushing means. In addition, a low wear of the bricks of the working lining comprising the flushing means is to be ensured.

This object is achieved according to the invention in that a rigid supply pipe for flush gas is led through the metal outer shell so as to reach into the permanent lining, to whose end lying in the permanent lining at least two, yet at most four, distributing pipes are welded, which diverge from the end of the supply pipe and pass over into a straight pipe section arranged in a recess of the bricks of the working lining, the distributing pipes connected to one supply pipe each enclosing one brick and the distance of the straight pipe sections from each other corresponding approximately to the width or length of a lining brick, and wherein only the straight pipe sections of the distributing pipes have flat cross sections.

A particularly simple manufacture of the bricks of the working lining preferably is ensured by arranging each distributing pipe, seen from above, at a corner of a brick of the working lining.

According to a preferred embodiment, which enables the simple production of the flushing means, the distributing pipes enter into the supply pipe laterally, extending arcuately outwards of the same, wherein the arcuate sections of the distributing pipes have round cross sections.

Suitably, with four distributing pipes per supply pipe, the supply pipe is arranged centrally between the distributing pipes, seen from above.

Figure 1:
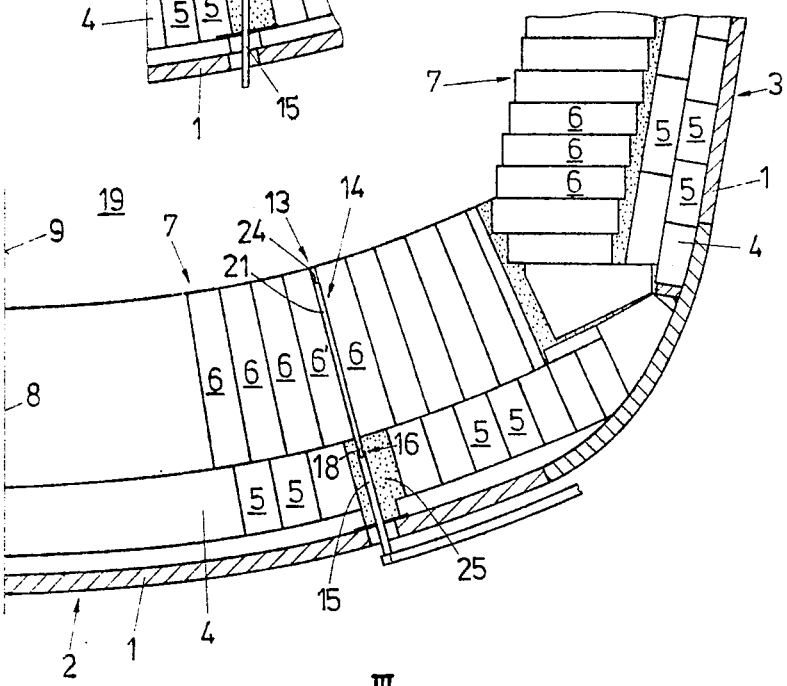
Figure 2:
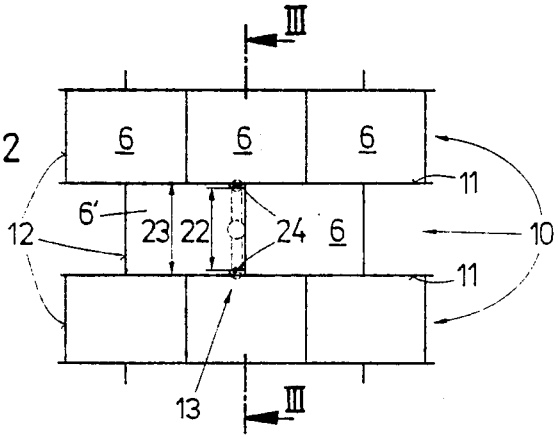
Figure 4:
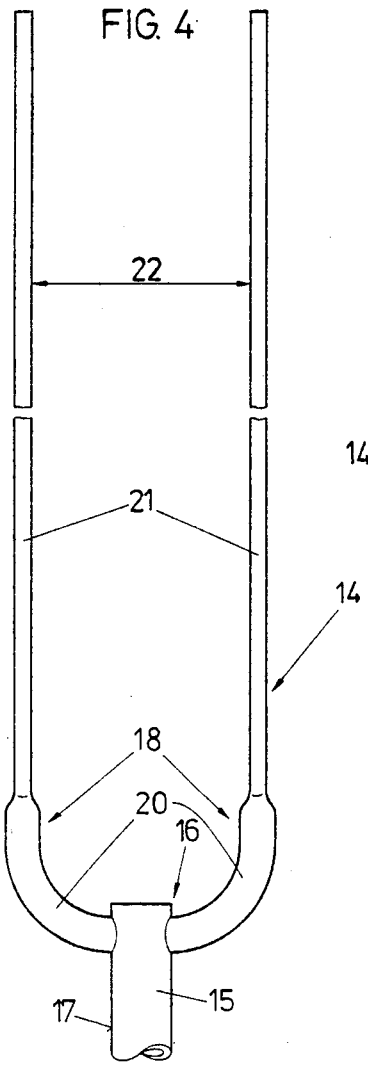
Figure 9:
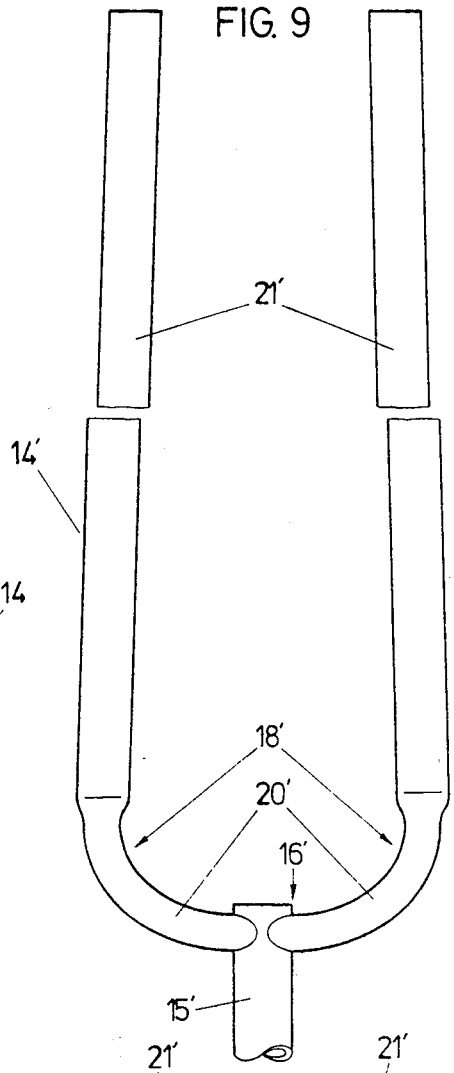
Figure 5:
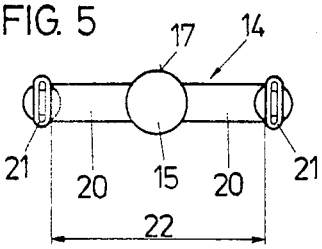
Figure 10:
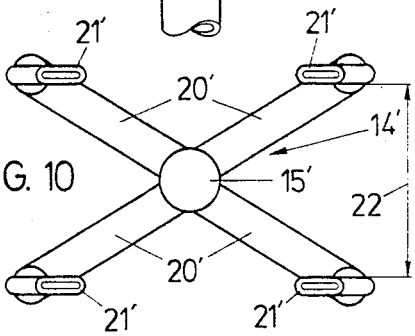
Figure 8:
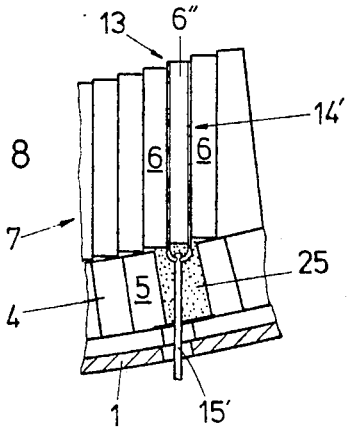
Figure 6:
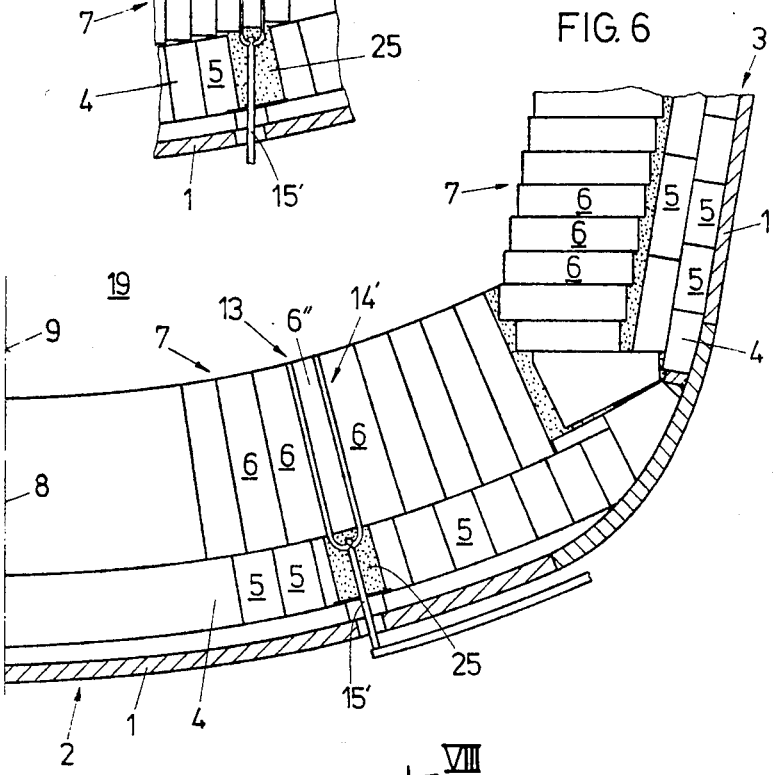
Figure 7:
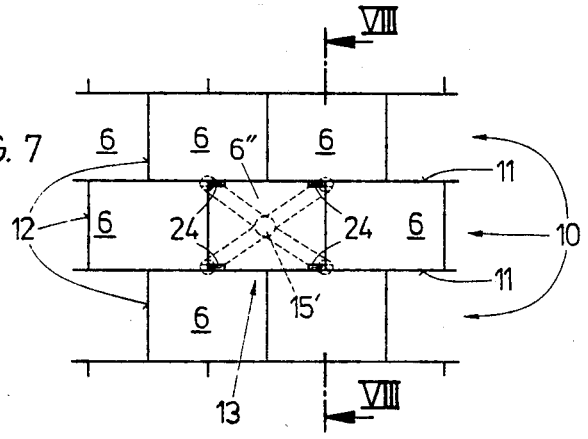

The invention will now be explained in more detail by way of two exemplary embodiments with reference to the accompanying drawings, wherein:

FIG. 1 is a longitudinal section through a steel works converter according to a first embodiment, FIG. 2 is a top view of the bottom of the above steel works converter, FIG. 3 is a section along line III—III of FIG. 2, FIGS. 4 and 5 illustrate the flushing means according to the first embodiment in side and plan views on an enlarged scale, and FIGS. 6 to 10 show a flushing means according to a second embodiment in illustrations analogous to FIGS. 1 to 5.

The steelworks converter illustrated in FIG. 1 comprises a metal outer shell 1, which inwardly is provided with a permanent lining 4 both on the bottom 2 and on the side walls 3. On the permanent lining, which is made of refractory bricks 5, a working lining 7 also made of refractory bricks 6 is provided. As is apparent from FIG. 2, the refractory bricks 6 of the working lining 7 are arranged in rows 10 departing radially from the center 8 of the bottom 2 or of the longitudinal axis 9 of the converter, wherein parallel rows 10 lie adjacent each other via longitudinal joints 11 and the bricks 6 of neighboring rows 10 are arranged in an offset manner. The neighboring bricks 6 of each row form transverse joints 12 running into the longitudinal joints 11 between neighboring rows 10 and each abutting on a side face of brick of a neighboring row 10.

On predetermined sites 13 of the bottom 2, which preferably are provided at approximately equal distances from the center 8 of the bottom 2 and also at approximately equal distances from each other, flushing means 14 are inserted. Each flushing means 14, according to the embodiment illustrated in FIGS. 1 to 5, is formed by a supply pipe 15 for the flush gas, which passes through the metal outer shell 1, extending to a height closely below the working lining 7.

On the end 16 of the end-sidely closed supply pipe 15, two distributing pipes 18 welded in the jacket 17 of the supply pipe are arranged, diverging from the end 16 of the supply pipe 15 in the direction towards the converter interior 19 in the form of a U-shaped arcuate section 20 designed like a fork. These arcuate sections 20 of the distributing pipes 18 are in the permanent lining 4 closely below the working lining 7. The arcuate sections 20 pass into straight flat-squeezed pipe sections 21 whose distance 22 approximately corresponds to the thickness 23 of a brick 6 of the working lining 7. One 6' of the bricks 6 of the working lining 7, in its corners, comprises flat recesses 24 that are designed with their cross sections corresponding to the cross sections of the pipe sections 21 and receive the pipe sections 21.

As is apparent from FIGS. 1 and 3, only a slight volume portion of the permanent lining 4 is interspersed with the flushing means 14 so that only a slight amount of ramming means 25 is required as a substitution for a brick 5 of the permanent lining 4 at the site of introduction of the supply pipe 15.

According to the embodiment of the flushing means 14' illustrated in FIGS. 6 to 10, four distributing pipes 18' depart from a supply pipe 15' arranged centrally below a brick 6'' of the working lining 7, likewisely extending arcuately outwards and upwards with parts 20' from the supply pipe 15' and passing over into straight pipe sections 21' each located in a corner recess 24 of the brick 6'' of the working lining 7.

Since the cross sectional area in which the flat pipe sections 21, 21' of the distributing pipes 18, 18' are each arranged is only very small, the wear at the joints 11 and 12 and, thus, the danger of fins in the joint or of a breakthrough of melt is only minimal. The flushing means 14, 14' is easy to install and requires no cumbersome mensuration of the distances of the distributing pipes 18 or 18'. Moreover, the distributing pipes are not subject to bending or damage when ramming the ramming mass 25 into the permanent lining 4 because of the round cross section of their arcuate parts 20, 20'.

The flushing means 14, 14', furthermore, stands out for a particularly low number of welds. The fork-like design of the distributing pipes 18, 18' allows for a good mobility of the same such that the flushing means if flexible enough to follow displacements of the refractory lining of the metallurgical vessel without causing distortions.

What I claim is:

1. A flushing arrangement for a metallurgical vessel including a metal outer shell, a bottom provided with a permanent lining, adjacently arranged refractory bricks applied onto said permanent lining so as to provide for a working lining, pipe means having flat cross sections and being inserted in recessed of said bricks at predetermined sites, and means to supply flush gas to flow through said pipes, the improvement comprising:

a rigid supply pipe for said flush gas extending through said metal outer shell into said permanent lining and having an end located in said permanent lining, said pipe means being comprised of at least two and at most four, distributing pipes welded to, and diverging from, said end of said supply pipe located in said permanent lining, each of said distributing pipes extending into a straight pipe section arranged in a recess of said bricks of said working lining, the distributing pipes which are connected to one supply pipe being arranged to enclose one of said bricks, the distance of said straight pipe sections from each other corresponds to approximately one of the width and length of said brick, and only said straight pipe sections of said distributing pipes have said flat cross sections.

2. A flushing arrangement as set forth in claim 1, wherein each distributing pipe is arranged at a corner of said brick of said working lining, seen from above.

3. A flushing arrangement as set forth in claim 1, wherein said distributing pipes enter into said supply pipe laterally and extend from said supply pipe outwards with arcuate sections, said arcuate sections of said distributing pipes having round cross sections.

4. A flushing arrangement as set forth in claim 1, wherein four distributing pipes are allocated to each supply pipe and said supply pipe is arranged centrally between said distributing pipes, seen from above.

* * * * *